US009031471B2

(12) United States Patent
Ohmura et al.

(10) Patent No.: US 9,031,471 B2
(45) Date of Patent: May 12, 2015

(54) DEVELOPMENT DEVICE AND IMAGE FORMING APPARATUS INCORPORATING SAME

(75) Inventors: Tomoya Ohmura, Kanagawa (JP); Yasuo Takuma, Kanagawa (JP); Junichi Matsumoto, Kanagawa (JP); Hiroshi Kikuchi, Kanagawa (JP); Natsumi Matsue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 599 days.

(21) Appl. No.: 13/137,509

(22) Filed: Aug. 23, 2011

(65) Prior Publication Data

US 2012/0051791 A1 Mar. 1, 2012

(30) Foreign Application Priority Data

Aug. 27, 2010 (JP) ..... 2010-190709

(51) Int. Cl.
*G03G 15/08* (2006.01)

(52) U.S. Cl.
CPC ..... *G03G 15/0879* (2013.01); *G03G 15/0844* (2013.01); *G03G 15/0887* (2013.01); *G03G 15/0896* (2013.01)

(58) Field of Classification Search
CPC ..... G03G 15/0879; G03G 15/0855; G03G 15/0865; G03G 2215/0802
USPC ..... 399/252–260
See application file for complete search history.

(56) References Cited

U.S. PATENT DOCUMENTS

| | | | | |
|---|---|---|---|---|
| 7,783,233 | B2 | 8/2010 | Iwata et al. | |
| 8,761,642 | B2 * | 6/2014 | Tajiri et al. | 399/258 |
| 2007/0264053 | A1 | 11/2007 | Iwata et al. | |

(Continued)

FOREIGN PATENT DOCUMENTS

| | | | |
|---|---|---|---|
| JP | 11143196 | A | 5/1999 |
| JP | 2001188408 | A | 7/2001 |

(Continued)

OTHER PUBLICATIONS

Abstract of Japanese Patent Publication No. JP08-123198, published on May 17, 1996.

(Continued)

*Primary Examiner* — Walter L Lindsay, Jr.
*Assistant Examiner* — Jessica L Eley
(74) *Attorney, Agent, or Firm* — Harness, Dickey & Pierce, P.L.C.

(57) ABSTRACT

A development device having a development portion with a developer spout, to develop a latent image formed on an image carrier with developer including toner and carrier particles. The development unit also includes a circulation unit to convey developer collected from the development portion to the developer spout, a developer container, provided in the circulation unit, to contain the developer at a position upstream from the development portion in a developer circular direction, the developer container having a cylindrical upper portion and a funnel-shaped lower portion continuous with the cylindrical upper portion through a joint so that a level of the developer contained in the developer container at rest is positioned near the joint between the cylindrical upper portion and the funnel-shaped lower portion. An agitator is provided inside the developer container, to agitate and mix the collected developer and fresh toner supplied to the developer container.

20 Claims, 9 Drawing Sheets

(56) References Cited

U.S. PATENT DOCUMENTS

| | | | | |
|---|---|---|---|---|
| 2008/0298844 | A1 | 12/2008 | Katoh et al. | |
| 2008/0298845 | A1 | 12/2008 | Ohmura et al. | |
| 2008/0298866 | A1 | 12/2008 | Matsumoto et al. | |
| 2009/0028611 | A1 | 1/2009 | Matsumoto et al. | |
| 2009/0123174 | A1 | 5/2009 | Iwata et al. | |
| 2009/0317106 | A1 | 12/2009 | Ohmura et al. | |
| 2010/0061774 | A1 | 3/2010 | Iwata et al. | |
| 2010/0124443 | A1* | 5/2010 | Ohmura et al. | 399/254 |
| 2010/0143000 | A1 | 6/2010 | Matsue et al. | |
| 2011/0182610 | A1 | 7/2011 | Ohmura et al. | |
| 2011/0219963 | A1 | 9/2011 | Schuermann et al. | |
| 2011/0293333 | A1* | 12/2011 | Shima | 399/258 |
| 2012/0057890 | A1* | 3/2012 | Takuma et al. | 399/53 |

FOREIGN PATENT DOCUMENTS

| | | | |
|---|---|---|---|
| JP | 3734096 | | 10/2005 |
| JP | 2008299196 | A | 12/2008 |
| JP | 2010-122539 | | 6/2010 |
| JP | 2010139564 | A | 6/2010 |

OTHER PUBLICATIONS

Office Action for corresponding Japanese patent application No. 2010-190709 dated Mar. 4, 2014.

* cited by examiner

DEVELOPMENT DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-190709, filed on Aug. 27, 2010, in the Japan Patent Office, the entire disclosure of which is hereby incorporated herein by reference.

BACKGROUND OF THE INVENTION

1. Field of the Invention

The present invention related to a development device and an image forming apparatus incorporating the development device, and more particularly, to a development device including an agitation mechanism for agitating two-component developer.

2. Description of the Background Art

A related-art image forming apparatus, such as a copier, a facsimile machine, a printer, or a multifunction printer having two or more of copying, printing, scanning, and facsimile functions, forms a toner image on a recording medium (e.g., a sheet) according to image data using an electrophotographic method. In such a method, for example, a charging device charges a surface of an image bearer (e.g., a photoconductor); an optical scanning device emits a light beam onto the charged surface of the photoconductor to form an electrostatic latent image on the photoconductor according to the image data; the electrostatic latent image is developed with a developer (e.g., a toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

In such an image forming apparatus, either a one-component developer consisting essentially of a toner (e.g., magnetic toner and non-magnetic toner) or a two-component developer including toner particles and carrier particles that carries the toner is used for development. The toner, when agitated and mixed into the carrier, is frictionally charged so as to be electrostatically attracted to the electrostatic latent image formed on the photoconductor. Thus, the toner is consumed during development whereas the carrier is not.

A typical development device, which holds the developer, generally includes a development sleeve, configured to form a magnetic brush of the developer on a surface thereof and to supply the developer to the electrostatic latent image formed on the photoconductor, and an agitation sleeve, configured to supply agitated developer to the developing sleeve. Developer in which the toner has been consumed in the development of the electrostatic latent image formed on the photoconductor is collected and returned to the development device.

Consumption of the toner included in the developer causes a decrease in image density, and therefore fresh toner needs to be supplied to the developer. The fresh toner may be supplied from above a conveyance screw including a screw auger serving as the agitation sleeve, or from an edge of a rotation shaft of the conveyance screw.

The fresh toner is supplied to the developer by controlling a number of rotations of a supply member configured to supply the fresh toner stored in a toner supply unit based on developer concentration detected by a toner concentration sensor or the like. When the fresh toner is poured into the developer in a developer tank, the fresh toner and a carrier are agitated by the conveyance screw provided in the vicinity of the supply member so that the developer is frictionally charged. As a result, the developer having a predetermined or desired charge is supplied to the development sleeve.

In general, the supplied toner is dispersed throughout the developer, and the developer is frictionally charged by being agitated by rotation of the screw auger for a short time until the developer thus prepared is conveyed to the development sleeve. Consequently, the degree of mixing depends in part on the amounts supplied.

Thus, when a larger amount of toner is supplied to the developer, the toner may not be dispersed sufficiently in the developer in the brief time allotted for agitation, and consequently, the toner may not be charged sufficiently when discharged from the developer tank. As a result, weakly charged toner could reach the development sleeve, fouling a surface of the photoconductor and scattering over peripheral components, thereby degrading image quality.

When the screw auger described above is used, only that developer which contacts the screw auger itself is agitated, as is the case when using a stirring paddle. Consequently, the supplied toner may not be sufficiently dispersed in the developer and reliably charged in the developer tank.

One possible method for solving the above-described problem is to provide an interior screw auger and an exterior screw auger positioned respectively inboard and outboard of a rotary shaft, and agitate the developer using multiple flows. However, developer in a gap between the screw augers cannot be agitated, and therefore only providing multiple screw augers, by itself, is not a solution.

In order to improve agitation, it is conceivable to increase the rotation velocity of the rotary member or the number of rotations thereof, or to narrow the gap between the screw augers. However, the screw auger driving system may be damaged due to the increased transfer resistance to the developer when the developer is agitated. Moreover, the toner may be damaged due to increased force of impact on the developer and heat caused by increased friction, increasing stress on the developer.

When the stress on the developer is increased, charging ability may be degraded by pealing away the carrier coating, and the charging ability and the fluidity may be degraded by burying additives in the toner. The degradation of the fluidity causes fluctuation in the charging ability and the transfer rate, thus degrading the image.

Alternative approaches include providing a developer container to agitate and mix developer and fresh toner provided separately from a development portion of the development device, but even with such a configuration, the problems of insufficient mixing of toner and developer as well as stress on the developer particles remain unresolved.

SUMMARY OF THE INVENTION

In one exemplary embodiment of the present invention, a development device that includes a development portion, a circulation unit, a developer container, and an agitator. The development portion, having a developer spout, develops a latent image formed on a latent image carrier with developer including toner and carrier particles. The circulation unit conveys the developer collected from the development portion to the developer spout in the development portion. The developer container is provided in the circulation unit and contains the developer at a position upstream from the development portion in a direction in which the developer is circulated. The developer container has a cylindrical upper portion and a funnel-shaped lower portion continuous with the cylindrical upper portion through a joint so that a level of the developer contained in the developer container at rest is positioned near the joint between the cylindrical upper portion and the funnel-shaped lower portion. The agitator is provided inside the developer container and agitates and mixes the collected developer and fresh toner supplied to the developer container.

In another exemplary embodiment, a development device includes the above-described development portion, the above-described circulation unit, a developer container, and the above-described agitator. The developer container is provided in the circulation unit and stores the developer at a position upstream from the development portion in a direction in which the developer is circulated. The developer container has a frustum of a circulator-conical upper portion and a funnel-shaped lower portion continuous with the frustum of the circulator-conical upper portion through a joint so that a level of the developer contained in the developer container at rest is positioned near the joint between the frustum of circulator-conical upper portion and the funnel-shaped lower portion.

In yet another exemplary embodiment, an image forming apparatus includes a latent image carrier to carry a latent image; and a development device to develop a latent image. The development device includes the above-described development portion, the above-described circulation unit, a developer container, and the above-described agitator. The developer container is provided in the circulation unit and stores the developer at a position upstream from the development portion in a direction in which the developer is circulated. The developer container has one of a cylindrical upper portion and a frustum of circulator-conical upper portion and a funnel-shaped lower portion continuous with one of the cylindrical upper portion and the frustum of circulator-conical upper portion through a joint so that a level of the developer contained in the developer container at rest is positioned near one of the joint between and the cylindrical upper portion and the funnel-shaped lower portion and the joint between the frustum of circulator-conical upper portion and the funnel-shaped lower portion.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
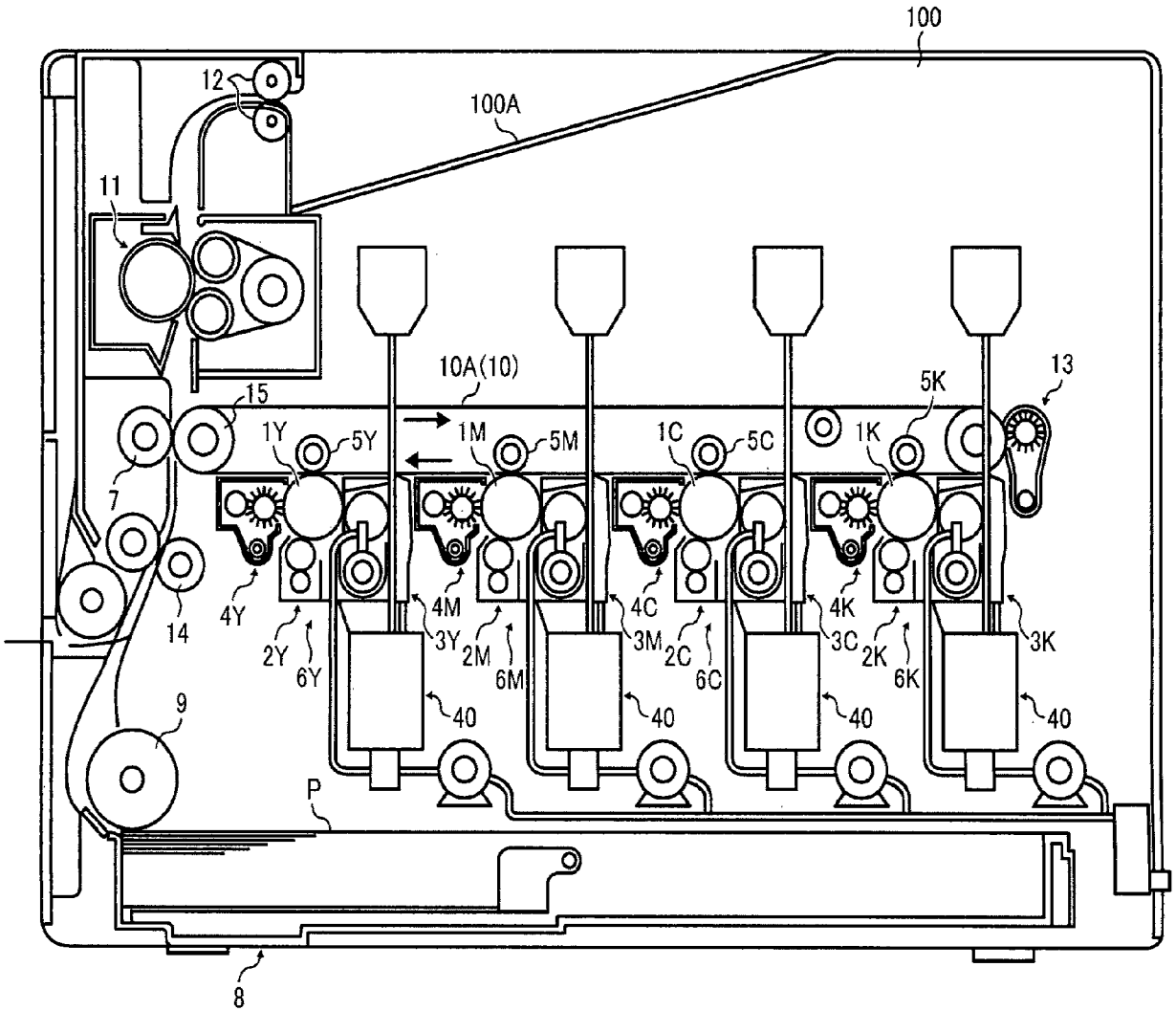
FIG. 1 is a schematic diagram illustrating an image forming apparatus employing a development device according to exemplary embodiments.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer but used for a copier, a facsimile machine, a printer, a multifunction printer having at least one of copying, printing, scanning, plotter, and facsimile functions, or the like.

The image forming apparatus 100 in FIG. 1 includes an intermediate transfer unit 10. Image forming units 6Y, 6M, 6C, and 6K for respectively forming black, magenta, cyan, and yellow (hereinafter also simply "K, M, C, and Y") single-color toner images are disposed facing the lower surface of an intermediate transfer belt 10A in the intermediate transfer unit 10.

It is to be noted that, in this specification, reference character suffixes Y, M, C, and K attached to an identical reference numeral indicate only that components indicated thereby are used for forming different single-color images, respectively, and hereinafter may be omitted when color discrimination is not necessary.

As shown in FIG. 1, a drum-shaped photoreceptor 1 functions as a latent image carrier, and a charging device 2, a development portion 3 of the development device 300, and a cleaning device 4 are disposed around the photoreceptor 1 in each of the image forming units 6. On the photoreceptor drum 1, image forming process including a charging process, an exposure process, a development process, a primary transfer process, and a cleaning process is executed, and thus a desired toner image is formed on the photoreceptor drum 1.

The photoreceptor drum 1 is rotated clockwise by a driving mechanism, not shown, and, in the charging process, the surface of the photoreceptor drum 1 is uniformly charged in a portion facing the charging device 2. When the surface of the photoreceptor drum 1 reaches a portion receiving a laser beam emitted from an exposure device, not shown, in the exposure process, the laser beam scans the surface of the photoreceptor drum 1, thus forming a latent image on the portion receiving the laser beam. Then, the portion of the surface of the photoreceptor drum 1 reaches a portion facing the development portion 3, and the latent image thereon is developed into a toner image with the toner included in developer supplied from the development portion 3, that is, development process is executed.

In the primary transfer process, the surface of the photoreceptor drum 1 that carries the toner image developed in the development process reaches the portion facing the intermediate transfer belt 10A and primary transfer bias rollers 5, where the toner image on the photoreceptor drum 1 is transferred onto the intermediate transfer belt 10A. After the transfer process, the surface of the photoreceptor drum 1 reaches a portion facing the cleaning device 4, where un-transferred toner that remains on the surface of the photoreceptor drum 1 is collected by the cleaning device 4 in the cleaning process. After the cleaning process electrical potential on the surface of the photoreceptor drum 1 is initialized by a discharging roller, not shown. Undergoing these processes, the image forming process performed on the photoreceptor drum 1 is completed.

The above-described image forming process is executed in both monochrome printing in black and white and multicolor printing. When multicolor printing is executed, four image forming units 6Y, 6M, 6C, and 6K perform the above-described processes, respectively. Namely, the exposure device (optical writing member), not shown, positioned beneath the image forming units 6 irradiates the respective photoreceptor drums 1 in the image forming units 6 with the respective laser beams in accordance with image data. After that, the toner images formed on the respective photoreceptor drums 1Y, 1M, 1C, and 1K in the development process are primarily transferred from the photoreceptor drums 1 and superimposed one on another on the surface of the intermediate transfer belt 10A. Thus, a multicolor (four-color) image is formed on the intermediate transfer belt 10A The intermediate transfer belt 10A is sandwiched between the primary transfer bias rollers 5Y, 5M, 5C and 5K and the photoreceptor drums 1Y, 1M, 1C and 1K, and primary transfer nips are formed therebetween, respectively. Each primary transfer bias roller 5 applies a transfer bias that has a reverse polarity (e.g., positive polarity) to the polarity of the toner to a backside (inner circumference face) of the intermediate transfer belt 10A. While the intermediate transfer belt 10A moves in a direction indicated by arrows shown in FIG. 1 and goes through the primary transfer nips sequentially, the respective toner images on the photoreceptor drums 1Y, 1M, 1C, and 1K are primarily transferred and are superimposed one on another on the surface of intermediate transfer belt 10A.

The intermediate transfer belt 10A is sandwiched between a secondary transfer roller 7 and a secondary transfer bias roller 15, and a secondary transfer nip is formed there between. When the four-color toner image formed on the surface of the intermediate transfer belt 10A reaches the secondary transfer nip, the four-color toner image is transferred onto a transfer sheet P, serving as recording media, at one time.

A feeding device 8 is disposed in a lower portion of the image forming apparatus 100 and contains multiple transfer sheets P. The transfer sheet P is fed one-by-one by a feed roller 9. The transfer sheet P thus fed is stopped by a pair of registration rollers 14, and then skew of the transfer sheet P is corrected, after which the pair of the registration rollers 14 transport the transfer sheet P toward the second transfer nip at an appropriate timing. Thus, the desired multicolor toner image is transferred onto the transfer sheet P at the second transfer nip. The transfer sheet P onto which multicolor image is transferred at the second transfer nip is transported to a fixing device 11 positioned above the secondary transfer roller 7 in FIG. 1, where the four-color toner image thus transferred is fixed on the surface of the transfer sheet P with heat and pressure in a fixing process.

After the fixing process, the transfer sheets P are discharged toward a discharge sheet tray 100A located on an upper portion of the image forming apparatus 100 via a pair of discharging sheet rollers 12 and are stacked on the discharge sheet tray 100A. Thus, a series of the image forming process completes.

The image forming apparatus 100 further includes a cleaning mechanism 13 that cleans the intermediate transfer belt 10A.

Figure 2:
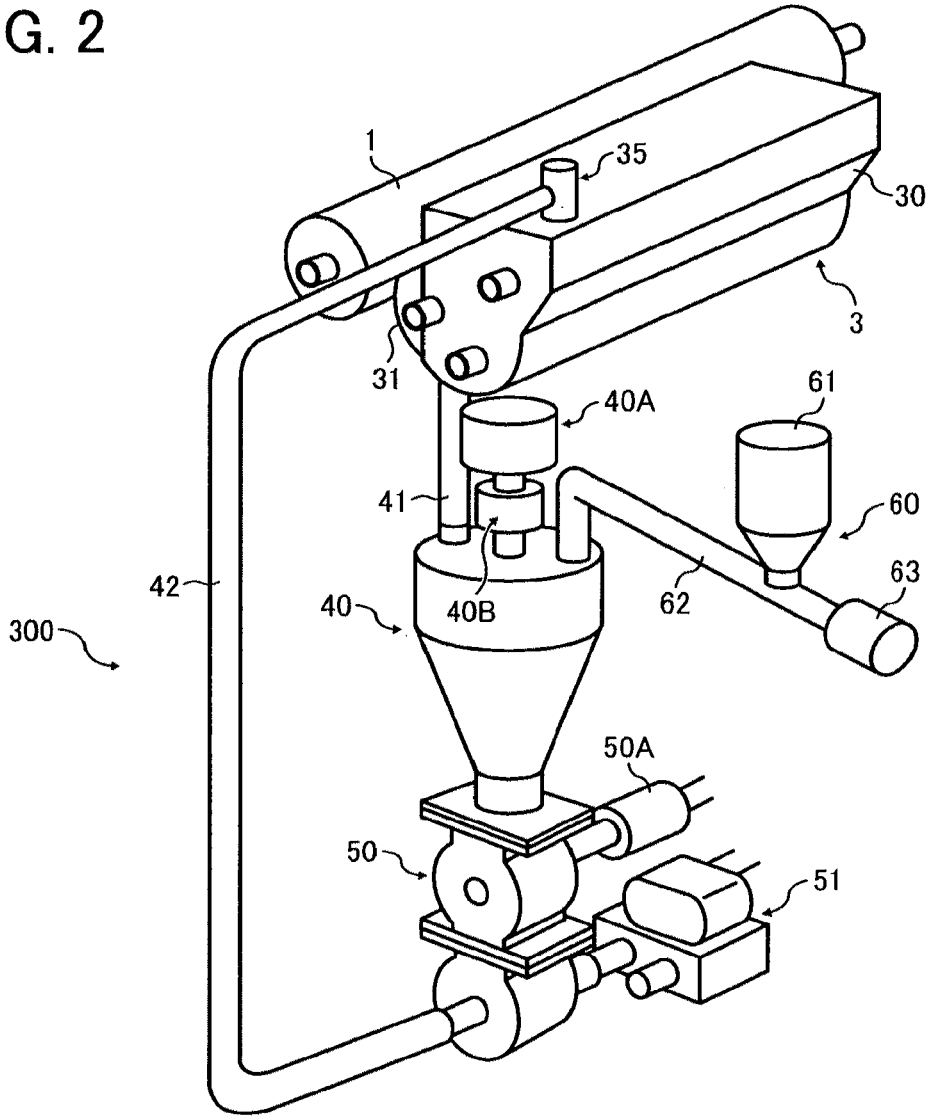
FIG. 2 is a perspective view illustrating an entire configuration of the development device shown in FIG. 1.

FIG. 2 illustrates an entire configuration of the development device 300 according to the present embodiment. The development device 300 shown in FIG. 2 includes a development portion 3 and a circulation unit, which are described in further detail later. The development portion 3 executes the development process on the photoreceptor drums 1 by using two-component developer in which carrier particles and toner particles are mixed. The circulation unit conveys the developer collected from the development portion to a developer spout 35 in the development portion 3.

In FIG. 2, the development device 300 includes the development portion 3 (development tank), the developer container 40, a rotary feeder 50, an air pump 51, and a toner supply device 60. The development portion 3 is capable of containing the developer that develops an electrostatic latent image on the photoreceptor drum 1, and in the configuration shown in FIG. 1 the development portion 3 is formed into a cartridge. The developer container 40 that is located separately from the development portion 3 agitates and mixes the developer collected from the development portion 3 with fresh toner whose amount corresponds to the amount of the consumed toner. The rotary feeder 50 transports the developer discharged from the developer container 40 after being agitated therein. The air pump 51 functions as a developer circulation driving source to convey the developer to the development portion 3 with pressurized air.

The toner supply device 60 (toner cartridge) supplies the fresh toner to the developer container 40 via a toner-supplying tube 62. A circulation route is formed with a collecting tube 41 and a supplying tube 42, and both tubes connect the development portion 3 and the development container 40. In the configuration shown in FIG. 2, the collecting tube 41 directly connects a lower portion of the development portion 3 with an upper portion of the developer container 40. Further, a lower portion of the developer container 40 and an upper portion of the development portion 3 are connected by the supplying tube 42 through the rotary feeder 50 that is located beneath the development portion 3. Thus, a circulation route is formed, and devices provided therealong function as circulation units.

More specifically, the supplying tube 42 is connected to an upstream side of a top face of a upper chamber of the developer portion 3 including the conveyance screw 32 in a direction in which the developer is conveyed (hereinafter "developer transport direction"). Further, the collecting tube 41 is connected to a downstream side of a bottom face of a lower chamber the developer portion 3 including the conveyance screw 33 (shown in FIG. 3) in the developer transport direction.

The developer container 40 has an upper portion that is cylindrical and a funnel-shaped lower portion. Inside the developer container 40 agitators (to be described in detail below) are provided. A driving motor 40A that drives the agitators and a torque sensor 40B that detects the rotation torque of agitators 44 and 45 (see FIG. 4) are provided above the developer container 40.

Figure 4:
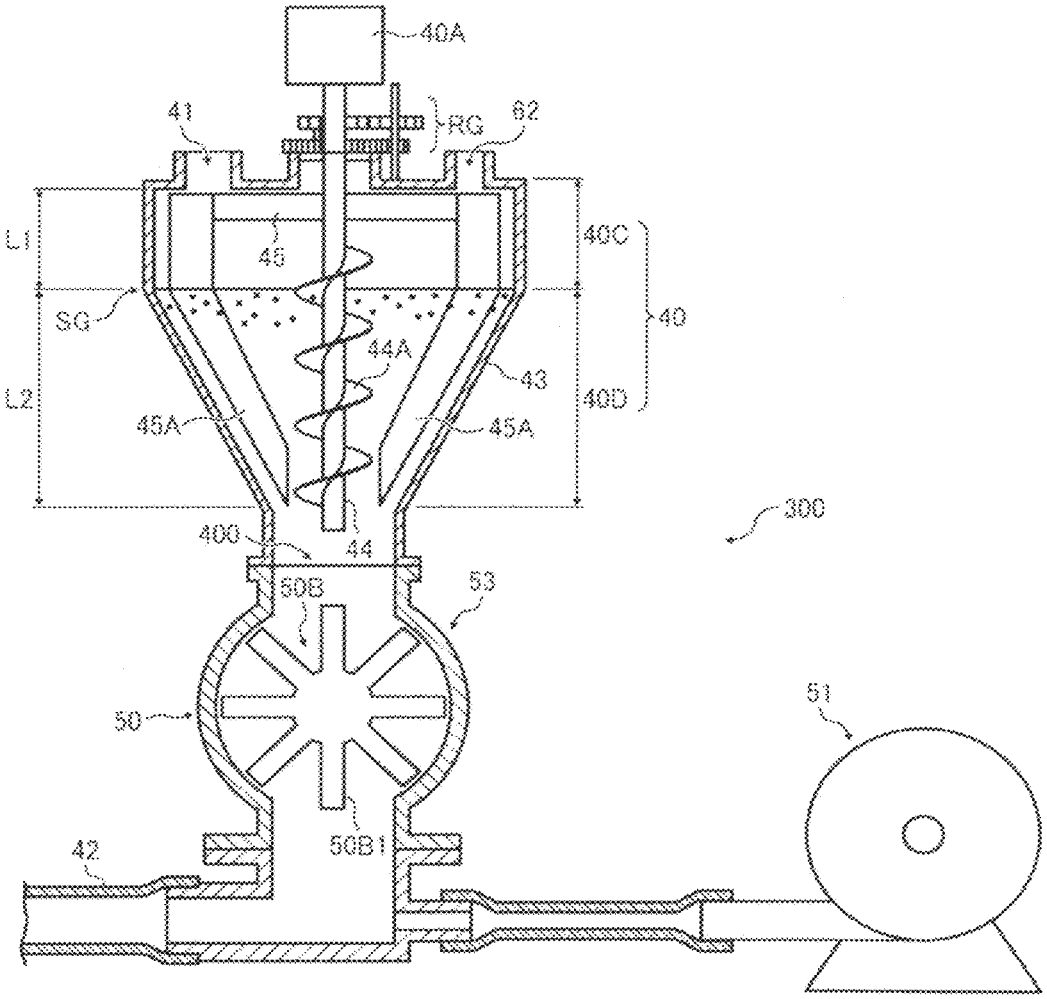
FIG. 4 is a vertical cross-sectional view illustrating a developer container in the development device show in FIG. 2.

The developer agitated in the developer container 40 is supplied to the rotary feeder 50 that can adjust the amount of the supplied developer by rotating an impeller 50B located therein (shown in FIG. 4). The impeller 50B includes blade portions 50B1 driven by a driving motor 50A. The developer whose amount is thus adjusted is supplied to the development portion 3 by airflow generated by the air pump 51.

The toner supplying device 60 includes a toner tank 61, the toner-supplying tube 62 connecting the toner tank 61 to the developer container 40, and a driving motor 63 that drives a conveying member, not shown, such as a screw auger in the toner-supplying tube 62. The development portion 3 includes a development sleeve 31 and the conveyance screws 32 and 33, which is described in detail below.

Figure 3:
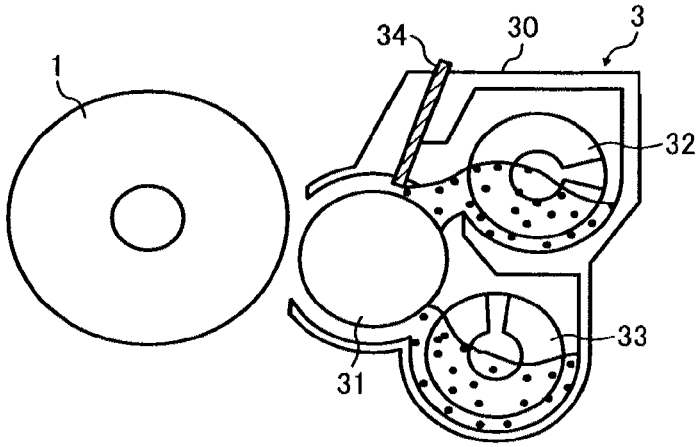
FIG. 3 is a schematic view illustrating an internal configuration of a development portion in the development device shown in FIG. 2.

The interior structure of the development portion 3 is shown in FIG. 3. As shown in FIG. 3, the development portion 3 includes a doctor blade 34 in addition to the development sleeve 31 and the conveyance screws 32 and 33, and the developer portion 3 is surrounded by a casing 30. The development sleeve 31 carries the developer and is disposed facing the photoreceptor drum 1. The doctor blade 34 adjusts the amount of the developer carried on the development sleeve 31. The conveyance screws 32 and 33 are offset from the developer sleeve 31 so that they are located respectively higher than and lower than the developer sleeve 31.

The first conveyance screw 32 moves the developer supplied from the supplying tube 42 through the developer spout 35 in a top of the development portion 3 toward the front side the paper sheet on which FIG. 3 is drawn and the second conveyance screw 33 conveys the developer from one end to the another end thereof. After the conveyance screw 32 moves the developer front end to back end of the conveyance screw 32 shown in FIG. 3, developer magnetically attracted by the development sleeve 31 is smoothed by the doctor blade 34 to a uniform thickness. When the surface of the photoreceptor drum 1 contacts the developer where the photoreceptor drum 1 faces the development sleeve 31 (hereinafter "development region"), an electrostatic latent image on the photoreceptor drum 1 is developed with the toner into the toner image thereon.

Developer that passes unused through the development region is discharged and conveyed to the developer container 40 via the collecting tube 41 (shown in FIG. 2) located on an extreme downstream portion of the conveyance screw 33 in the developer transport direction. A toner concentration detector is provided in the extreme downstream portion of the conveyance screw 33 in a direction in which the developer is transported. Fresh toner is supplied from the toner tank 61 in accordance with a signal from the toner concentration detector. As described above, the toner is supplied by a conveyance screw, not shown, disposed in the toner-supplying tube 62.

Next, a configuration and operation of the developer container 40 of the development device 3 used in the above-described image forming apparatus is described below, with reference to FIG. 4. FIG. 4 illustrates an internal structure of the developer container 40, the rotary feeder 50, and the air pump 51. As shown in FIG. 4, the developer container 40 has a container casing 43 that is shaped like an upright cylinder, a lower end of which forms a funnel (upside-down cone), that is, a tapered portion of downwardly decreasing diameter. More specifically, the developer container 40 is formed by a cylindrical portion 40C and a funnel portion 40D continuous with a bottom of the cylindrical portion 40C.

Where the cylindrical portion 40C meets the funnel portion 40D is a border or joint SG. The height, or length (L1), of the cylindrical portion 40C above the joint SG is less than a length (L2) of the funnel portion 40D below the joint SG (i.e., $L1<L2$). With this configuration, the developer is raised to the cylindrical portion 40C along a side wall of the funnel portion 40D when a centrifugal force caused by an agitation blade that is one of the agitators is exerted on the developer.

As shown in FIG. 4, the collecting tube 41 and the toner-supplying tube 62 are provided on the top of the container casing 43 of the developer container 40. A discharge opening 400 whose diameter is smallest in the container casing 43 of the developer container 40, provided at the bottom of the funnel portion 40D, is continuous with the rotary feeder 50.

Meanwhile, a screw agitator 44A that extends vertically from a horizontal center portion of the upper surface of the container casing 43 of the developer container 40, and a blade agitator 45A located outside of the screw agitator 44A are provided inside the developer container 40.

The screw agitator 44A extends coaxially along a rotary shaft 44 that extends in an axis direction that is a vertical direction extending between the driving motor 40A and the funnel portion 40D through the cylindrical portion 40C. The agitators 44A and 45, functions as rotary members, rotate around a rotary axis coaxial with the developer container 40. The blade agitator 45A is integrally formed with an upper end blade 45 that moves in conjunction with output gears of a decelerated gear group RG that is driven by the driving motor 40A, and therefore, the blade agitator 45A is rotatable. The torque sensor 40B shown in FIG. 2 is omitted in FIG. 4.

The screw agitator 44A is rotated in conjunction with the rotary shaft 44 that directly receives the rotary force from the driving motor 40A, and by contrast, the agitation blade 45 is rotated in conjunction with the upper end plate 45 that receives the rotary force from the driving motor 40A through the decelerated gear group RG. With this configuration, rotation velocity of the blade agitator 45A is different from that of the screw agitator 44A.

In the present embodiment, a rotation direction of the screw agitator 44A is a guide direction in which the developer is moved in a direction opposite the dropping direction, and a rotation direction of the blade agitator 45A is a direction in which dropping the developer is restrained by moving the blade agitator 45A across the dropping developer, such that the centrifugal force of the agitators 44A and 45A during agitation is exerted on the developer.

The number of rotations of the blade agitator 45A is set such that the developer is lifted from the funnel portion 40D to the cylindrical portion 40C positioned above the joint SG and then, the developer lifted to the cylindrical portion 40C drops by gravity. That is, the developer is raised in the funnel portion 40D by being subjected to the centrifugal force generated when the blade agitator 45A is rotated. The developer thus raised then topples inward toward a center portion of the developer container 40 by gravity when the developer reaches the cylindrical portion 40C, thus falling from the cylindrical portion 40C back into the funnel portion 40D.

Meanwhile, similarly to the blade agitator 45A, since the screw agitator 44A lifts the developer from the funnel portion 40D to the cylindrical portion 40C, the developer lifted by the multiple agitators 44A and 45A is agitated and mixed above the funnel portion 40D.

Next, a description is given of a feature of the developer container, that is, that the developer is contained in the developer 40 such that the upper surface (hereinafter "level") of the developer at rest is positioned near the joint SG between the cylindrical portion 40C and the funnel portion 40D.

As noted above, the amount of the developer contained in the developer container 40 affects agitation performance and the stress on the developer. Although agitation efficiency is increased when the developer amount is increased, the stress on the developer at the bottom of the container is increased by the weight of the developer at the top.

In order to avoid the developer at the bottom from being subjected to the weight load of the developer at the top, in the present embodiment, since the developer is moved from the funnel portion 40D to the cylindrical portion 40C, the weight load on the developer at the bottom is not exerted unless the developer is moved in the cylindrical portion 40C.

This increase of stress on the developer at the bottom caused by the weight load of the developer at the top is significant when a large amount of the developer is retained in the cylindrical portion 40C. To avoid this phenomenon, the level of the developer at rest is set near the joint SG between the cylindrical portion 40C and the funnel portion 40D so as not to permit much of the developer into the cylindrical portion 40C.

With this configuration, occurrence of the stress caused by piling up of the developer in the cylindrical portion 40C can be alleviated because the amount of the piled up developer in the cylindrical portion 40C is reduced, and the developer is agitated in a state in which the lifted developer showers down on the developer close to the joint SG by gravity. Accordingly, dispersion and mixing can be increased.

Figure 6:
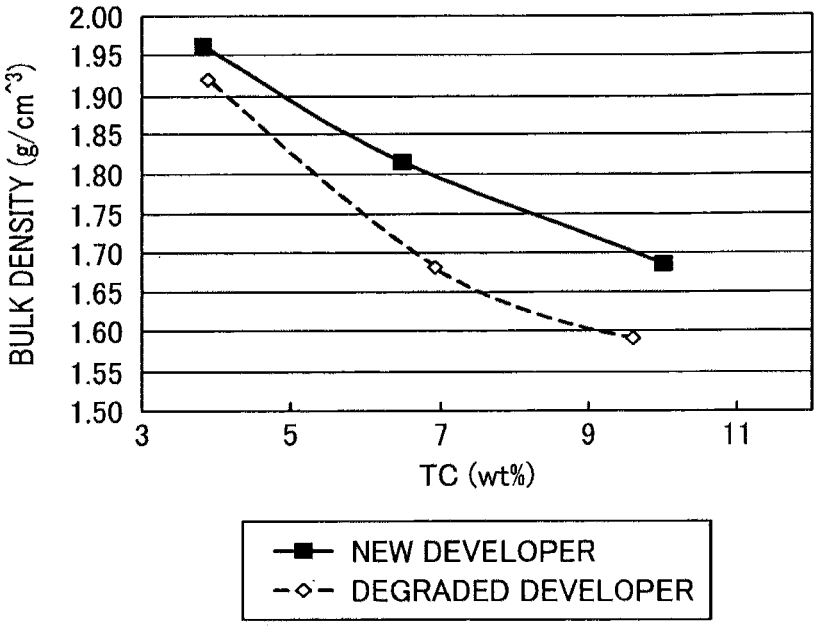
FIG. 6 is a graph illustrating loose bulk density relative to a new developer and a degraded developer.

Meanwhile, the level of the developer at rest is set based on a bulk density of the developer. The reason is described as follows: The bulk density of the developer is changed depending on fluctuation in the environment (e.g., humidity), fluctuation in the toner concentration, and extent or state of degradation of the developer. For example, the loose bulk density changes with the change in toner concentration using the new developer and degraded developer as shown in FIG. 6.

In the present experiment, loose bulk density was measured by the weight of the developer that falls into a 50 milliliter (mL) developer container 40 through an opening whose diameter is 5 mm, and the excessive developer straying from the container was removed. In the developer, the diameter of toner particles is 5 μm, and the diameter of carrier particles is 35 μm. In FIG. 6, although the bulk density is changed from 1.6 g/cm$^3$ to 1.95 g/cm$^3$, if the environment fluctuates further, it is conceivable that the range of change is within 1.5 g/cm$^3$ to 2.0 g/cm$^3$ of the bulk density. In this regard, since the bulk density is changed depending on the diameters of the toner particles and carrier particles and additives, it is necessary to consider the fluctuation range of the bulk density in each case.

In order to obtain good agitation performance, the level of the developer (powder level) should be set in view of the fluctuation in the bulk density because the position of the level of the developer contained in the developer container at rest varies with the bulk density. In the present embodiment, the level of the developer at rest is set lower than the joint SG between the cylindrical portion 40C and the funnel portion 40D when the bulk density of the developer is at an upper limit. By contrast, the level of the developer at rest is set higher than the joint SG when the bulk density of the developer is at a lower limit. The level of the developer is set at this state, which prevents the amount of the developer from becoming extremely small or large and can maintain good agitation performance for the same reason as the adjustment of the amount of the developer does.

Figure 5:
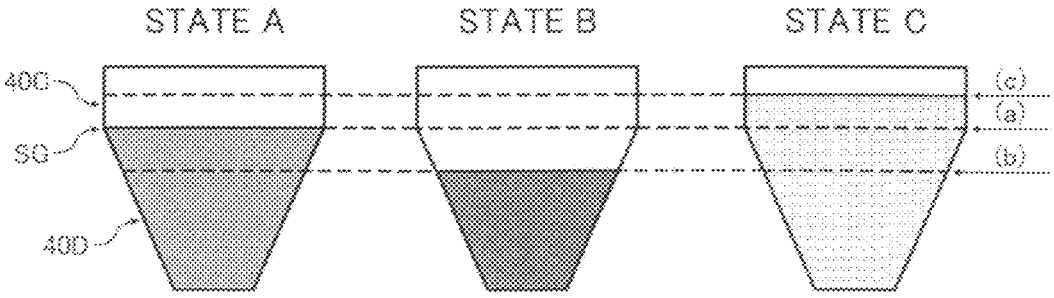
FIG. 5 is pattern diagram illustrating relation between level of the developer and bulk density.

FIG. 5 shows a pattern diagram of the level of the developer in the developer container 40. A state B represents a state in which the level of the developer when the bulk density of the developer is at the upper limit, and a level (b) of the developer at rest is set lower than a position (a) of the joint SG between the cylindrical portion 40C and the funnel portion 40D. A state C represents a state in which the level of the developer when the bulk density of the developer is at the lower limit, and a level (c) of the developer at rest is set higher than the position (a) of the joint SG. In the present embodiment, as shown in a state A of FIG. 5, the level of the developer is set near the position (a) of the joint SG under normal conditions in which the developer is at a control central value, for example, a central value of the toner concentration. Thus, good agitation performance can be obtained.

Figure 7A:
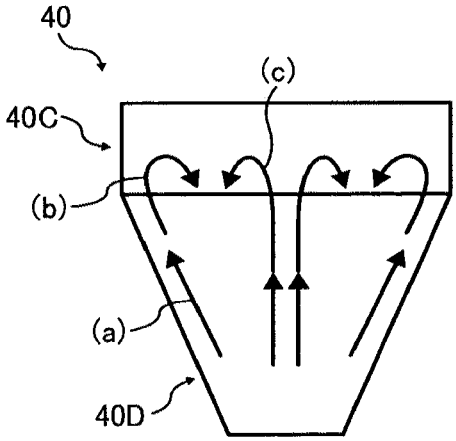
FIG. 7A is a pattern diagram illustrating convective motion of the developer in the developer container shown in FIG. 4.
Figure 7B:
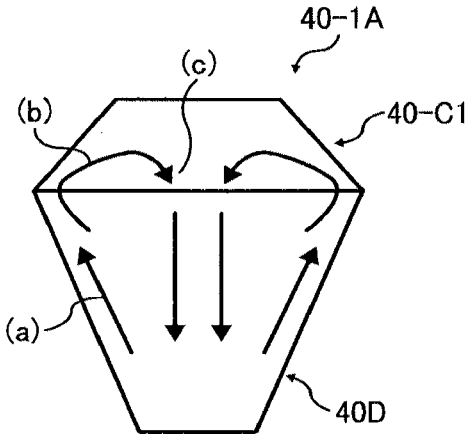
FIG. 7B is a pattern diagram illustrating convective motion of the developer in a developer container according to another illustrative embodiment.
Figure 13:
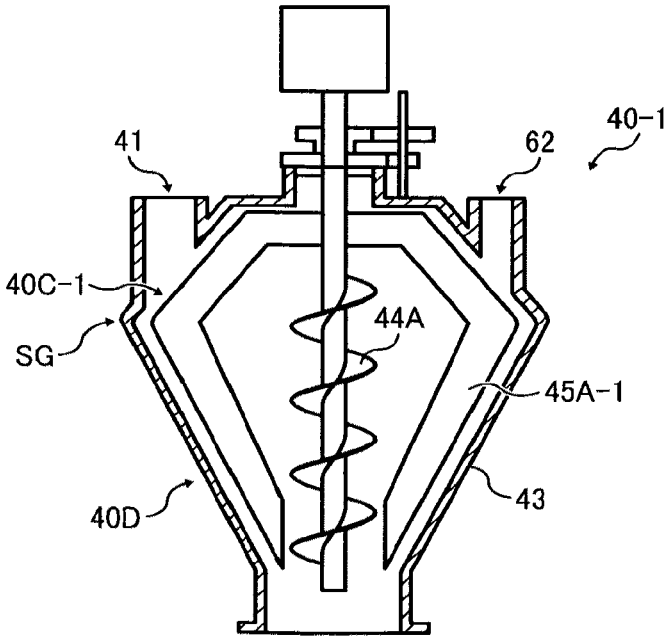
FIG. 13 is a vertical cross-sectional view illustrating the developer container according to another embodiment.
Figure 14:
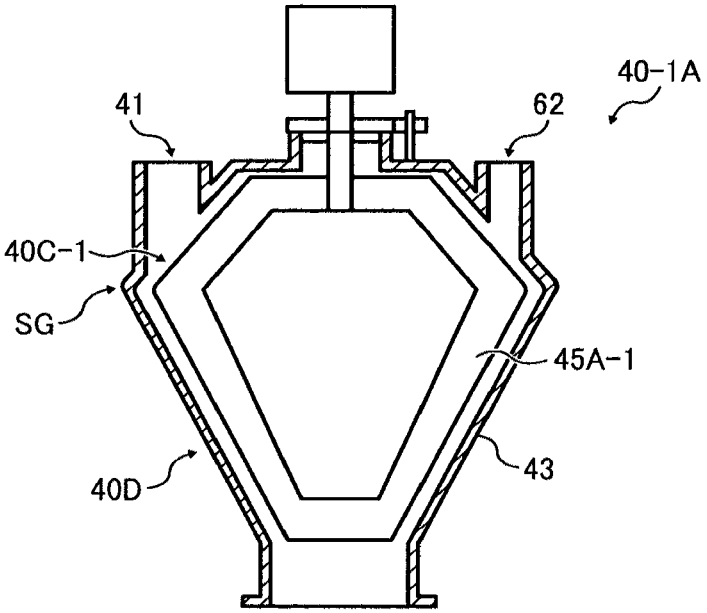
FIG. 14 is a vertical cross-sectional view illustrating the developer container shown in FIG. 7B according to yet another embodiment.

FIG. 7A is a pattern diagram illustrating a movement of the developer in the developer container 40 according to a present embodiment shown in FIG. 4. FIG. 7B is a pattern diagram illustrating a movement of the developer in developer toner container 40-1 and 40-2 as shown in FIGS. 13 and 14 according to other embodiments as described later. Arrows in FIGS. 7A and 7B represent movements of the developer. Due to rotation of the blade agitator 45A, the developer is raised to a side wall of the funnel portion 40D of the developer container 40 by the centrifugal force. At this time, since the lower portion the funnel portion 40D of the container casing 43 of the developer container 40 is upside-down cone, and the developer is raised along the side wall of the funnel portion 40D of the developer container 40 in a direction indicated by arrow (a) shown in FIG. 7. The lifted developer reaches the cylindrical portion 40C and then drops by gravity indicated by arrow (b). Meanwhile, the screw agitator 44A located in the center position rotates the developer to lift the developer upward in a direction indicated by arrow (c), and finally, the developer drops by gravity.

As noted above, since the outer developer is mixed with the developer positioned in the center position, high disperse ability can be achieved. If the level of the developer during agitation does not reach the cylindrical portion 40C (the level of the developer is lower than the joint) unlike the present embodiment, the developer moved outer side of the developer container 40 by the centrifugal force cannot be moved to the center position. Accordingly, in this case, the developer cannot be mixed to each other.

Herein, the inventors of the present disclosure carried out an experiment for indicating effect of the developer container of the represent embodiment on the agitation performance.

Figure 8C:
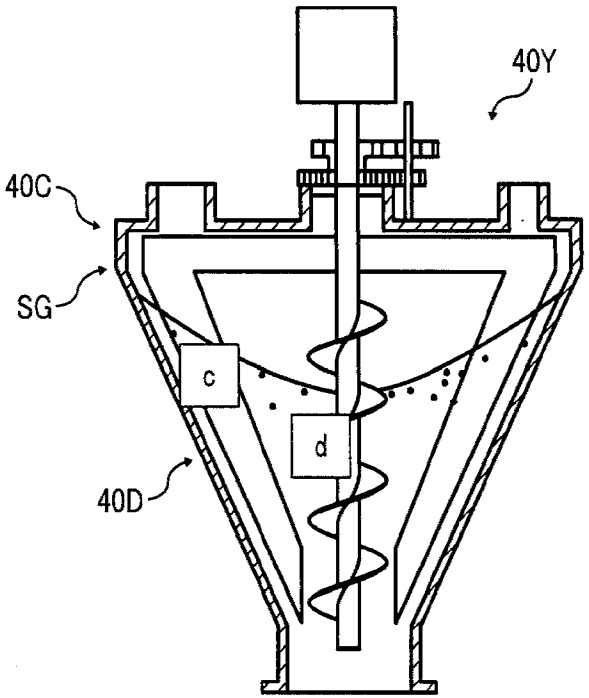
FIG. 8C is a pattern diagram illustrating level of the developer in a developer container according to a second comparative example.
Figure 8B:
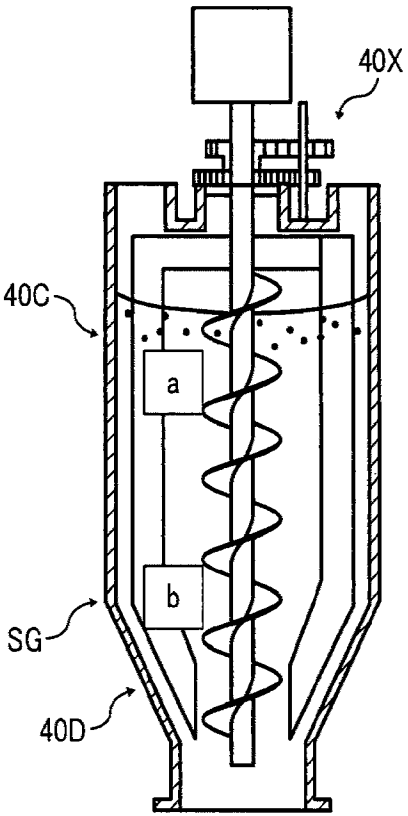
FIG. 8B is a pattern diagram illustrating level of the developer in a developer container according to a first comparative example.
Figure 8A:
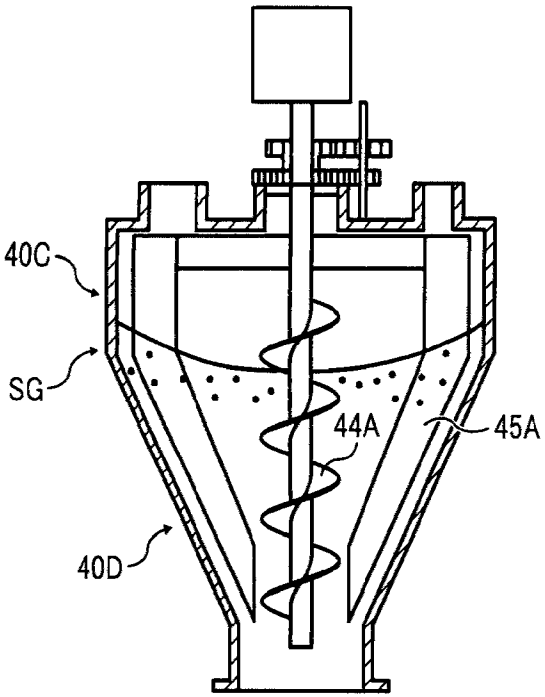
FIG. 8A is a pattern diagram illustrating level of the developer in the developer container shown in FIG. 4.

FIG. 8A shows a condition in which the level of the developer at rest is set near the joint SG between the cylindrical portion 40C and the funnel portion 40D according to the present embodiment. FIG. 8B shows a condition in which the level of the developer at rest is set higher than a joint SG in a developer container 40X according to a first comparative example. FIG. 8C shows a condition in which the level of the developer at rest is set lower than a joint SG in a developer container 40Y according to a second comparative example. More particularly, in the condition of FIG. 8C, the level of the developer is set lower than the joint SG when the developer is agitated. The shapes of the containers 8X and 8Y are changed such that the amount of the developer in the respective developer containers 8, 8Y, and 8Z are identical thereamong. The shape of FIG. 8A is called "standard type", the shape of FIG. 8B is called "small-diameter type", and the shape of FIG. 8C is called "large-diameter type".

Figure 9A:
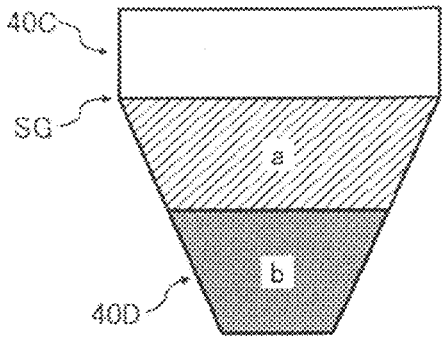
FIG. 9A is a pattern diagram illustrating positions of toner particles and carrier particles in the developer container.

The agitation performance of the developer containers 40 and 40X in a vertical direction (gravitational direction) was measured as follows: Initially, carrier whose amount to be a desired toner concentration (toner concentration is 10 wt % in the present experiment) was set at bottom and the toner was disposed above the carrier in the developer container 40, 40X, as illustrated in FIG. 9A. The agitation was carried out in a state in which the discharge openings 400 positioned lower end of the developer container 40 and 40X were closed.

Subsequently, the developer located at a position "a" and a position "b" shown in FIG. 9A was taken as a sample, and the toner concentration of the sample was measured. The toner concentration vs time were plotted in FIGS. 9B and 9C. The toner concentration in the standard type of the developer container 40 is shown in FIG. 9B, and that in the small-diameter type of the developer container 40X is shown in FIG. 9C.

Figure 9B:
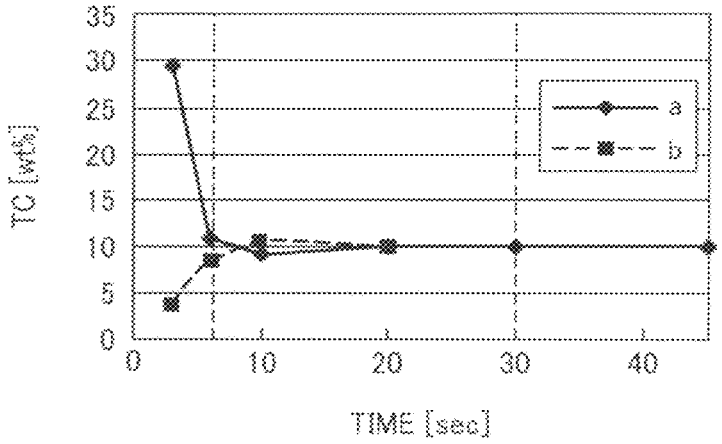
FIGS. 9B and 9C show a result of an experiment in agitation performance in a gravity direction in the developer container shown in FIG. 8A and the developer container shown in FIG. 8B.
Figure 9C:
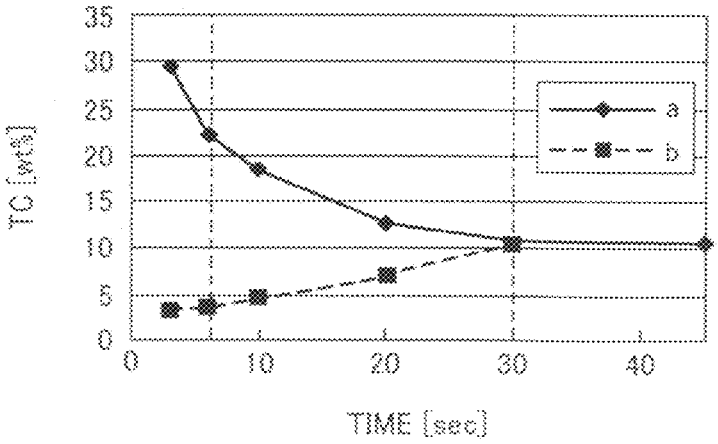

As illustrated in FIGS. 9B and 9C, convergence of the toner concentration in the standard condition of the developer container 40 is significantly earlier than that in the small diameter condition of the developer container 40X, more specifically, the convergence of the toner concentration of the standard condition is approximately six times rapid speed as that in the small diameter condition. This is because, when the level of the developer is higher, the agitation performance in the vertical direction is degraded, and it takes longer time to agitate the developer sufficiently.

In addition, during development operation of the development device 3, it is necessary to agitate sufficiently for a short time until the developer flows from up to down in the developer container 40, and the developer in the entire developer container 40 should be agitated rapidly, like the present embodiment.

Figure 10A:
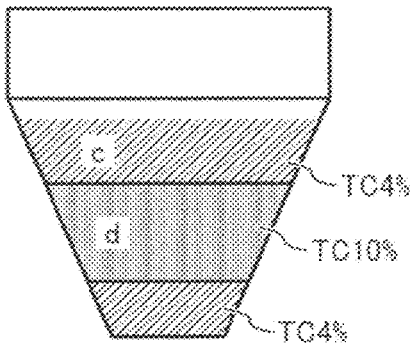
FIG. 10A is a pattern diagram illustrating positions of the developer including difference toner concentrations in the developer container.
Figure 10B:
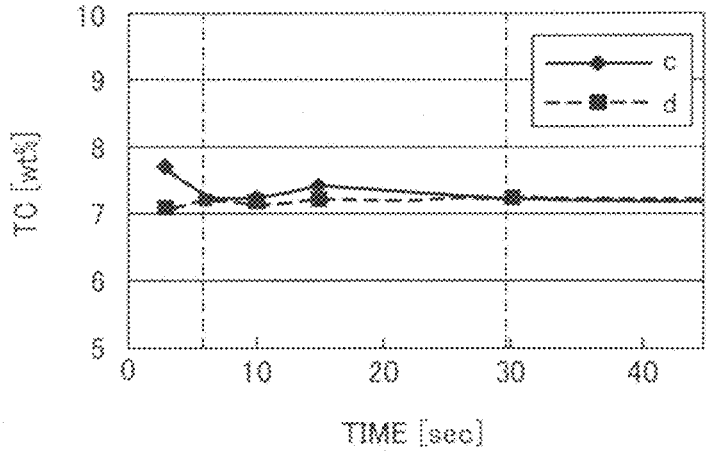
FIGS. 10B and 10C show a result of an experiment in the agitation performance in a horizontal direction in the developer container shown in FIG. 8A and the developer container shown in FIG. 8C.
Figure 10C:
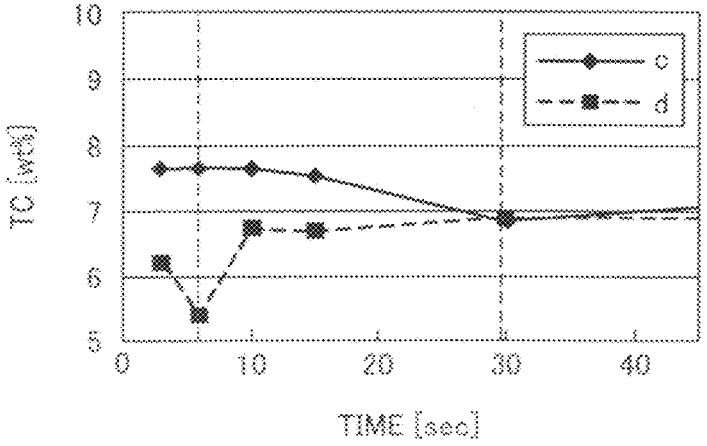

In addition, the agitation performance of the developer containers 40 and 40X in a horizontal direction (lateral direction) was measured as follows: Initially, predetermined toner concentration of the developer is contained in the developer container 40 and 40Y such that the developer having higher toner concentration (TC 10%) is sandwiched between the developer having lower toner concentration (TC 4%) in vertical direction as illustrated in FIG. 10A. Then, the developer after agitation was taken as a sample from a position c and a position "d", and the toner concentration thereof was measured. The toner concentration in the standard type of the developer container 40 is shown in FIG. 10B, and that in the large-diameter type of the developer container 40Y is shown in FIG. 10C. As illustrated in FIGS. 10B and 10C, convergence of the toner concentration of the standard type is approximately six times earlier speed as that in the small-diameter type. This is because, as described above, in a condition in which the level of the developer during agitation does not reach the cylindrical portion, the external developer spread by the centrifugal force during agitation cannot be mixed with the developer in the center position, Thus, in order to keep the agitation performance of the developer in the horizontal direction, it is necessary to set the level of the developer higher than the joint SG between the cylindrical portion 40C and the funnel portion 40D. If the level of the developer is too high, the agitation performance of the developer in the vertical direction is inhibited. Therefore, by setting the level of the developer near the joint SG, consistent agitation performance in the entire developer container 40 can be obtained.

Alternatively, by dramatically decreasing the amount of the developer in the developer container, the time until the developer in the developer container is sufficiently agitated can be shorted. However, in this way, the fluctuation in the toner concentration when the toner is supplied becomes larger because the fluctuation in the toner concentration of the developer at a predetermined amount of the supplying toner becomes smaller as the amount of the developer in the developer container is increased. In this case, the toner concentration of the developer to be supply to the developing area may become unstable, which is not preferable.

Figure 11:
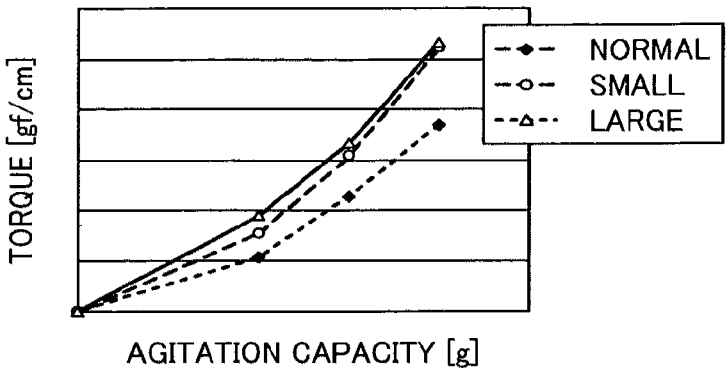
FIG. 11 shows a result of an experiment in developer agitation torque in the developer containers shown in FIGS. 8A, 8B, and 8C.

Next, torque exerted on the agitators during agitation in the three types of the developer containers 40, 40X, and 40Y (standard, small diameter, and large diameter) were compared. FIG. 11 illustrate a graph plotting the total agitation torque exerted on the agitators 44A and 45A in the respective developer containers 40, 40X, and 40Y, relative to an agitation capacity (g). As is clear in FIG. 11, of the three types, the agitation torque in the standard type is the smallest.

In the small-diameter type developer container 40X in which the level of the developer is higher than the joint SG since the level of the developer is high, the developer at the bottom is compressed by the developer at the top, and the developer is agitated while being compressed, which causes the torque to increase. Meanwhile, in the large-diameter type developer container 40Y, the developer is biased to the side wall of the developer container 40Y during agitation, and the torque is greater to the outer side. With this configuration, it is conceivable that the torque in the large-diameter type developer container 40Y is greater than that of the standard type the developer container 40 because excessive torque is not exerted on the developer by the fall of the developer that has reached the cylindrical portion 40C in the standard type developer container 40.

This torque increase occurring in the small diameter condition and large diameter condition causes deterioration of the developer and image quality failures such as toner scattering and black dots in the background image by exerting excessive stress on the developer.

Figure 12:
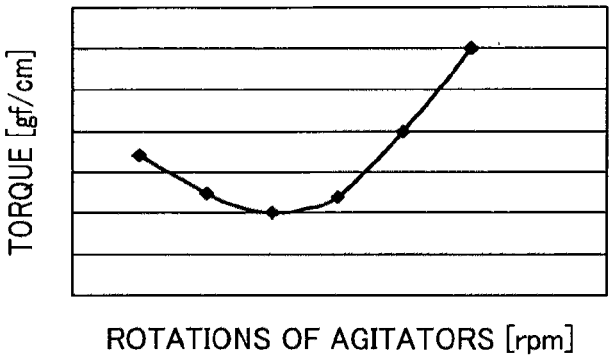
FIG. 12 shows a relation between the developer agitation torque and number of rotations of agitators.

In an effect to counteract the above-described problem that, by setting the rotation amount of the agitator such that the agitation torque is minimal, the uniformity of the developer can be improved, and the stress on the developer can be alleviated. More specifically, as illustrated in FIG. 12, as the number of rotations of the agitator is increased, the torque at first decreases and then increases. This phenomenon is influenced by the viscosity of the developer. That is, as the rotation velocity is increased from a small number of rotations, the developer becomes fluidized, and then the torque becomes minimal. After the fluidization of the developer reaches a predetermined state, even when the number of rotations is further increased, the developer is not further fluidized any more. Then, as the bulk density of the developer becomes lower, the torque is increased by increasing the number of rotations of the agitators. In the present embodiment, because the agitators 44A and 45A are rotated at a number of rotations within a range such that the agitation torque is minimal, the deterioration of the developer can be prevented without added stress on the developer.

Second embodiment

Next a developer container 40-1 according to a second embodiment is described below with reference to FIG. 13. The developer container 40-1 is formed by a frustum of circular-cone portion 40C-1 and the funnel portion 40D connected to the frustum of circular-cone portion 40C-1 through the joint SG. In the present embodiment, since the upper portion is formed by the frustum of circular-cone portion 40C-1, the developer lifted by the agitator drops to the center portion thereof, and disperse ability can be more improved. In addition, with this configuration, the movement of the developer is greater in an outer side and an inner side, and accordingly, better agitation performance in the horizontal direction and the vertical direction can be sufficiently obtained.

Accordingly, it is not necessary to provide a spiral screw agitator (screw agitator 44A). In a variation of the second embodiment, there is only external blade agitator 45A constituted as the agitator in a developer container 40-1A shown in FIG. 14, thus simplifying the configuration of the developer container. In this configuration shown in FIG. 14, the developer is moved by convection as shown in FIG. 7B.

As for the shape of the developer container 40-1, it is preferable that the angle of inclination of the funnel portion 40D be set to between 30 degrees to 60 degrees inclusive relative to the horizontal. In particular, 45 degree is most suitable angle to move the developer in the vertical direction and the horizontal direction. It is to be noted that it is a minimum condition that this angle is set such that the developer can be discharged smoothly without inhibiting the developer from discharging. Relating to the shape angle of the frustum of circular-cone portion 40C-1, in order to avoid exerting stress on the developer when contacting the developer with the inner wall thereof, it is preferable that the angle of inclination of the frustum of circular-cone portion 40C-1 be set to 45 degrees relative to the horizontal. Relating to the junction node SG, it is preferable that connection angle be set such that the developer and toner be not agglomerated in a horn of the joint.

As described above, in the present disclosure, since the amount of the developer contained in the developer container is set by a position relation between the level of the developer and a changing point (joint SG) of shape of the container, it is necessary to monitor the level of the developer in the developer container. This monitoring is executed in a configuration in which an inspection window where an area including the joint SG can be seen from outside is provided in the side wall of the developer container and an optical detection sensor is provided in the inspection window, or a configuration in which a float sensor that is movable in the vertical direction based on the level of the developer.

In addition, a control method to keep the level of the developer at a predetermined consistent position, the disclosure of JP-2010-139564-A can be adapted. More specifically, development device in this disclosure further includes a controller and a developer-level detection sensor that uses a piezoelectric element to detect the level of the developer. The developer-level detection sensor is connected to an input side of the controller, a driving unit to drive a developer discharger (rotary feeder 50) that discharges the developer from the developer container after agitation is connected to an input side of the controller. With this configuration, the controller adjusts the amount of discharging developer in accordance with a detection signal from the developer-level detection sensor.

For example, when the developer-level detection sensor determines that the level of the developer is positioned higher than the joint SG of the developer by inputting pressure exerted on the piezoelectric element, the controller drives the rotary feeder 50 to promote discharge of the developer from the developer container 40 so as to lower the level of the developer. By contrast, when the developer-level detection sensor determines that the level of the developer is positioned lower than the joint SG of the developer by the absence of input of the pressure the piezoelectric element f, the controller changes the driving condition of the driving unit for the rotary feeder 50 to reduce the amount of discharging developer in the developer container 40. At this time, as a prerequisite, when the sensor determines that the developer concentration in the development portion 3 is insufficient, the controller returns the operation condition of the rotary feeder 50 to a predetermined condition, and the shortage of the developer concentration in the development portion 3 is made up.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a development portion, including a developer spout, to develop a latent image formed on a latent image carrier with developer including toner and carrier particles;

a circulation unit to convey developer collected from the development portion to the developer spout in the development portion;

a developer container provided in the circulation unit, to contain the developer at a position upstream from the development portion in a direction in which the developer is circulated, the developer container including a cylindrical upper portion; and a funnel-shaped lower portion continuous with the cylindrical upper portion through a joint portion; and an agitator, provided inside the developer container, to agitate and mix the collected developer and fresh toner supplied to the developer container, wherein a level of the developer contained in the developer container at rest is controlled based on a bulk density of the developer, when the bulk density of the developer is at an upper limit the level of the developer contained in the developer container at rest is lower than the joint portion, and when the bulk density of the developer is at a lower limit the level of the developer contained in the developer container at rest is higher than the joint portion.

2. The development device according to claim 1, wherein a length of the cylindrical upper portion in a longitudinal direction is shorter than that of the funnel-shaped lower portion.

3. The development device according to claim 1, wherein the agitator comprises a rotation member that rotates around a rotary axis coaxial with the developer container, and the rotation direction of the agitator is set such that the agitator moves the developer from the funnel-shaped lower portion to the cylindrical upper portion of the developer container.

4. The development device according to claim 3, wherein a number of rotations of the agitator is set such that the developer is lifted to a position higher than the joint portion and the developer moved in the cylindrical portion drops into the funnel-shaped lower portion by gravity.

5. The development device according to claim 3, wherein a number of rotations of the agitator is set such that developer agitation torque is minimized.

6. The development device according to claim 3, wherein the agitator comprises:

a blade agitator extending parallel to inner side faces of the cylindrical upper portion and the funnel portion; and a screw agitator extending coaxially along the rotary axis.

7. The development device according to claim 1, wherein a supply opening is formed in a top of the cylindrical upper portion of the developer container and a discharge opening is formed in a bottom of the funnel-shaped lower portion of the developer container.

8. The development device according to claim 1, wherein the development device further comprises a detector to detect the level of developer contained in the developer container.

9. A development device comprising:

a development portion, including a developer spout, to develop a latent image formed on a latent image carrier with developer including toner and carrier particles;

a circulation unit to convey the developer collected from the development portion to the developer spout in the development portion, a developer container, provided in the circulation unit, to store the developer at a position upstream from the development portion in a direction in which the developer is circulated, the developer container including a frustum of a circulator-conical upper portion and a funnel-shaped lower portion continuous with the frustum of the circulator-conical upper portion through a joint portion so that a level of the developer contained in the developer container at rest is set near the joint portion between the frustum of circulator-conical upper portion and the funnel-shaped lower portion; and an agitator provided inside the developer container, to agitate and mix the collected developer and fresh toner supplied to the developer container.

10. The development device according to claim 9, wherein a length of the frustum of circular-conical upper portion in a longitudinal direction is shorter than that of the funnel-shaped lower portion.

11. The development device according to claim 9, wherein the level of the developer contained in the developer container at rest is set corresponding to a bulk density of the developer, when the bulk density of the developer is at an upper limit, the level of the developer contained in the developer container at rest is set lower than the joint portion, and when the bulk density of the developer is at a lower limit, the level of the developer contained in the developer container at rest is set higher than the joint portion.

12. The development device according to claim 9, wherein the agitator comprises a rotary axis that extends axially along the developer container, and the rotation direction of the agitator is set such that the agitator moves the developer from the funnel-shaped lower portion to the frustum of circulator-conical upper portion.

13. The development device according to claim 12, wherein a number of rotations of the agitator is set such that the developer is piled up to a position higher than the joint portion, and the developer moved in the frustum of circulator-conical upper portion drops into the funnel-shaped lower portion by gravity.

14. The development device according to claim 12, wherein number of rotations of the agitator is set such that developer agitation torque is minimized in the developer.

15. The development device according to claim 12, wherein the agitator comprises a blade agitator extending parallel to inner side faces of the frustum of circulator-conical upper portion and the funnel-shaped lower portion in the developer container.

16. The development device according to claim 15, wherein the agitator further comprises a screw agitator extending coaxially along the rotary axis.

17. The development device according to claim 9, wherein a supply opening is formed in a top of the frustum of circulator-conical upper portion of the developer container and a discharge opening is formed in a bottom of the funnel-shaped lower portion of the developer container.

18. The image forming apparatus according to claim 9, wherein the development device further comprises a detector to detect the level of developer contained in the developer container.

19. An image forming apparatus comprising:

a latent image carrier to carry a latent image; and a development device to develop the latent image on the latent image carrier, the development device comprising:

a development portion, including a developer spout, to develop the latent image formed on the latent image carrier with developer including toner and carrier particles;

a circulation unit to convey the developer collected from the development portion to the developer spout in the development portion;

a developer container, provided in the circulation unit, to store the developer at a position upstream from the development portion in a direction in which the developer is circulated, the developer container including one of a cylindrical upper portion and a frustum of circulator-conical upper portion, and a funnel-shaped lower portion continuous with one of the cylindrical upper portion and the frustum of circulator-conical upper portion through a joint portion; and an agitator provided inside the developer container, to agitate and mix the collected developer and fresh toner supplied to the developer container, wherein a level of the developer contained in the developer container at rest is controlled based on a bulk density of the developer, when the bulk density of the developer is at an upper limit the level of the developer contained in the developer container at rest is lower than one of the joint portion between the cylindrical upper portion and the funnel-shaped lower portion and the joint portion between the frustum of circulator-conical upper portion and the funnel-shaped lower portion, and when the bulk density of the developer is at a lower limit the level of developer contained in the developer container at rest is set-higher than the joint portion.

20. The image forming apparatus according to claim 19, wherein the image forming apparatus further comprises a detector to detect the level of developer contained in the developer container.

* * * * *